US009687725B1

(12) United States Patent
Dawley et al.

(10) Patent No.: US 9,687,725 B1
(45) Date of Patent: Jun. 27, 2017

(54) BINDING ASSEMBLY FOR SPORT BOARD HAVING ANGLED CONNECTOR RECEPTACLES

(71) Applicant: Motion Water Sports, Inc., Encinitas, CA (US)

(72) Inventors: Bryan Dawley, Los Angeles, CA (US); Wade Motawi, Encinitas, CA (US); Tony Finn, Encinitas, CA (US)

(73) Assignee: MOTION WATER SPORTS, INC., Encinitas, CA (US)

( * ) Notice: Subject to any disclaimer, the term of this patent is extended or adjusted under 35 U.S.C. 154(b) by 0 days.

(21) Appl. No.: 15/077,759

(22) Filed: Mar. 22, 2016

(51) Int. Cl.
*A63C 10/00* (2012.01)
*A63C 10/14* (2012.01)
*A63C 10/28* (2012.01)

(52) U.S. Cl.
CPC ..... *A63C 10/14* (2013.01); *A63C 10/285* (2013.01)

(58) Field of Classification Search
CPC ..... A63C 10/02; A63C 10/20; A63C 10/14; A63C 10/145; A63C 10/285; B63B 35/812
See application file for complete search history.

(56) References Cited

U.S. PATENT DOCUMENTS

| | | | | |
|---|---|---|---|---|
| 6,017,256 | A * | 1/2000 | Gillis | B63B 35/812 441/70 |
| 6,095,881 | A * | 8/2000 | Neubauer | B63B 35/812 441/70 |
| 7,762,573 | B2 * | 7/2010 | Zaloom | A63C 5/03 280/611 |
| 8,182,269 | B2 * | 5/2012 | Rancon | A63C 5/003 280/626 |
| 9,415,846 | B2 * | 8/2016 | Shupe | B63B 35/812 |
| 2008/0122202 | A1 * | 5/2008 | Furr | A63C 10/12 280/626 |

* cited by examiner

*Primary Examiner* — Brian Swenson
(74) *Attorney, Agent, or Firm* — Mintz Levin Cohn Ferris Glovsky and Popeo, P.C.

(57) ABSTRACT

Described herein include various embodiments of a binding assembly that assist with coupling a user's foot to a sport board. A foothold or binding upper that captures a user's foot can be coupled to a part of the binding assembly thereby enabling the binding assembly to secure the user's foot to the sport board. The binding assembly can include a chassis that has at least two connector receptacle that each allow an attachment feature (e.g., mounting screw) to extend therethrough and secure the binding assembly to the sport board. Each of the connector receptacles can be angled such that a longitudinal of the connector receptacle is positioned at an angle relative to a top surface of the sport board.

20 Claims, 5 Drawing Sheets

BINDING ASSEMBLY FOR SPORT BOARD HAVING ANGLED CONNECTOR RECEPTACLES

TECHNICAL FIELD

The subject matter described herein relates to a binding assembly having angled connector receptacles that accept attachment features for coupling the binding assembly to a sport board.

BACKGROUND

Sport boards can have a variety of shapes and sizes, as well as include a variety of features that allow the sport boards to perform in various ways. For example, some sport boards can be flexible, as well as have a cambered and/or rockered shape that can provide certain benefits when performing certain tricks or riding certain types of terrain. Bindings for attaching a user's feet to the sport board can interfere with some of the features of the sport board. For example, bindings attached to the sport board can stiffen the otherwise flexible sport board. The camber in the sport board can also be reduced as a result of bindings attached to the sport board.

SUMMARY

Aspects of the current subject matter include a binding assembly that includes angled connector receptacles that allow attachment features to secure the binding assembly to a sport board where the attachment features are positioned at an angle relative to a top surface of the sport board. In one aspect, a binding assembly is described for a sport board is having at least two binding attachment receptacles in an upper surface of the sport board. The binding assembly can be mountable to the upper surface of the sport board by at least two attachment features that correspond with the at least two binding attachment receptacles. The binding assembly can further include a chassis having a peripheral member that defines at least a part of a perimeter of the chassis. The perimeter can include a toe region, a heel region, and outer and inner side regions. The chassis can further include a top side for receiving an upper of a binding that receives a foot of a rider of the sport board and a bottom side that faces the sport board when the chassis is mounted therewith. The chassis can further include at least two connector receptacles through the peripheral member. At least one connector receptacle at each of the outer and inner side regions of the perimeter and extending through the peripheral member at an angle inward from each of the outer and inner side regions of the perimeter toward a central region of the chassis such that each attachment feature engages through one of the connector receptacles to engage one of the at least two binding attachment receptacles inside a perimeter of the upper of the binding to mount the binding assembly to the upper surface of the sport board.

In some variations one or more of the following features can optionally be included in any feasible combination. For example, the angle can be within a range of 35 degrees to 55 degrees relative to the upper surface of the sport board. The binding assembly can further include a dampening member that engages to an underside of the chassis as the chassis is mounted to the sport board by the attachment features. The dampening member can be formed of a thermoplastic, such as one of a thermoplastic polyurethane and a thermoplastic elastomer. The upper of the binding can be attached to a boot that receives the foot of the rider of the sport board. The chassis can further include a plurality of slots for receiving a corresponding number of attachment mechanisms of the upper, with each of the attachment mechanisms including a downward projecting tab, and each tab can include a plurality of transverse ridges for engaging an engagement mechanism on an opposite of one of the plurality of slots of the chassis. The chassis can be at least one of formed out of a substantially rigid material and formed out of nylon. The peripheral member can include a side member that extends upwardly from the bottom of the chassis and that defines a shape of the bottom of the chassis. A first of the pair of connector receptacles extending from the chassis on opposite sides of the peripheral member can extend from an inner bridge area of the rider's foot, and the second of the pair of connector receptacles extending from the chassis on opposite sides of the peripheral member can extend from an outer metatarsal region of the rider's foot.

In another aspect, a binding assembly is described for a sport board having a pair of binding attachment receptacles in a planar upper surface of the sport board, with the binding assembly including a rigid chassis having a peripheral member that defines a perimeter of the chassis, an underside, and a bottom for receiving an upper of a binding to receive a foot of a rider of the sport board. The peripheral member of the rigid chassis can further include a pair of screw receptacles extending from the rigid chassis on opposite sides of the peripheral member, with each of the pair of screw receptacles having an opening for receiving a mounting screw at an angle of between 10 and 80 degrees relative to the planar upper surface of the sport board so as to allow a proximal head of the mounting screw to engage with one of the pair of screw receptacles and a distal, threaded end of the mounting screw to protrude through the rigid chassis at the angle to extend under the bottom of the rigid chassis to engage with a corresponding one of the binding attachment receptacles of the sport board. The binding assembly further including a dampening member that engages to the underside of the rigid chassis as the rigid chassis is mounted to the sport board by the pair of mounting screws. In some variations the angle can be within a range of 35 degrees to 55 degrees, such as 45 degrees relative to the upper surface of the sport board.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Figure 1:
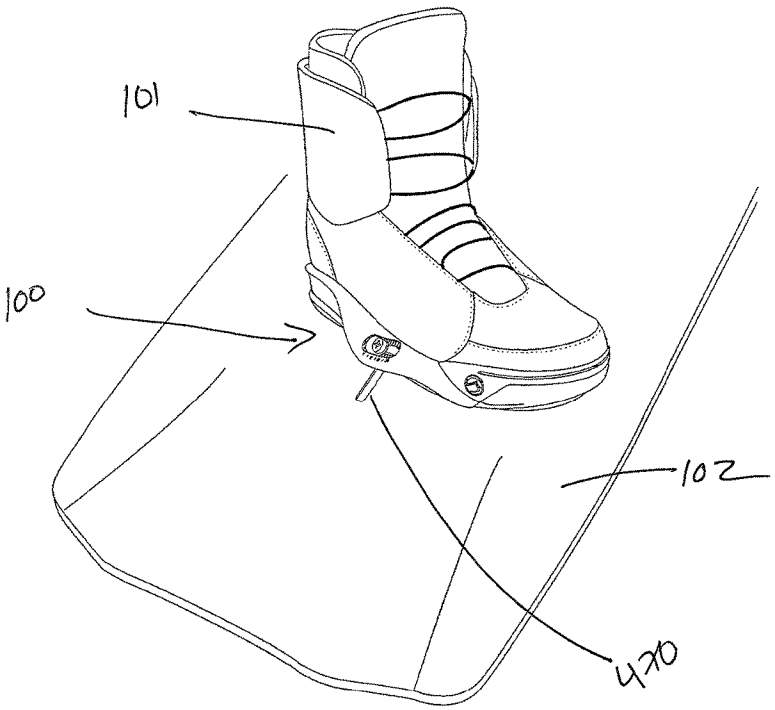
FIG. 1 shows an implementations of a binding assembly coupled to a top surface of a sport board.

Described herein include various embodiments of a binding assembly that assist with coupling a user's foot to a sport board, such as a wakeboard, snowboard, and/or kiteboard. A foothold or binding upper that captures a user's foot can be coupled to a part of the binding assembly thereby enabling the binding assembly to secure the user's foot to the sport board. The binding assembly can include a chassis that has at least two connector receptacle that each allow an attachment feature (e.g., mounting screw) to extend therethrough. Each of the connector receptacles can be angled such that a longitudinal axis of the connector receptacle is positioned at an angle relative to a top surface of the sport board. For example, this angle can be approximately 35 degrees to approximately 55 degrees, such as approximately 45 degrees. Attachment features can extend through the connector receptacles at the angle defined by the connector receptacles and assist with securing the binding assembly to the sport board.

For example, a proximal end of the attachment feature can secure against a part of the chassis and a distal end of the attachment feature can secure to an attachment receptacle coupled to or incorporated within the sport board. The attachment receptacle associated with the sport board can include a connection that is angled similar to the angled configuration of the connector receptacle to assist with securing the distal end of the attachment feature extending from the connector receptacle.

Conventional attachment methods for attaching bindings to sport boards include using hardware (e.g., screws or bolts) in which their longitudinal axis are positioned 90 degrees relative to the top surface of the sport board. This can have limitations and disadvantages. For example, attachment points between the hardware and sport board can require being positioned wider than the perimeter of the user's foot, which can require extending the chassis out from the sides of the user's foot to provide an attachment point outside of the foot perimeter. This can increase the overall weight of the bindings due to requiring extra material, as well as reduce the stiffness of the chassis. The reduction in stiffness can cause lifting of the toe and/or heel region of the binding during use, thus resulting in reduced structural support for the user's foot and weakening the structure of the chassis. The extended and wider chassis can also interfere with the flex and/or shape (e.g., camber) of the sport board and reduce the sport board's performance.

The chassis of the binding assembly disclosed herein includes attachment points that are positioned within the perimeter of the user's foot or the binding upper. As referred to herein, an attachment point is the location at which the attachment feature intersects the attachment receptacle and/or sport board when the biding assembly is secured to the sport board. Having the attachment points positioned within the perimeter of the user's foot can be accomplished, in part, by the angled connector receptacles. This configuration can also result in a binding assembly that is narrower and includes less material. As such, the binding assembly of the present disclosure can weigh less and maintain and/or improve the stiffness of the chassis, thereby improving the functionality and durabiltiy of the binding assembly. Furthermore, this configuration can result in a narrower binding footprint along the top surface of the board, which can reduce negative effects related to the board's ability to flex (e.g., reduce "dead spots") and thereby improve the overall performance of the sport board.

FIG. 1 illustrates an implementation of a binding assembly 100 coupled to a binding upper 101 and to a top surface of a sport board 102, such as a wakeboard. The binding upper 101 can secure a user's foot therein, which can allow the user to be secured to the sport board 102. Although shown as a boot-shaped binding upper 101, the binding assembly can be coupled to any number of features that capture a part of a user's foot for securing to the sport board 102. Furthermore, the binding assembly 100 can be coupled to any number of sports boards 102, such as a wakeboard, surfboard, kiteboard, snowboard, etc.

Figure 2:
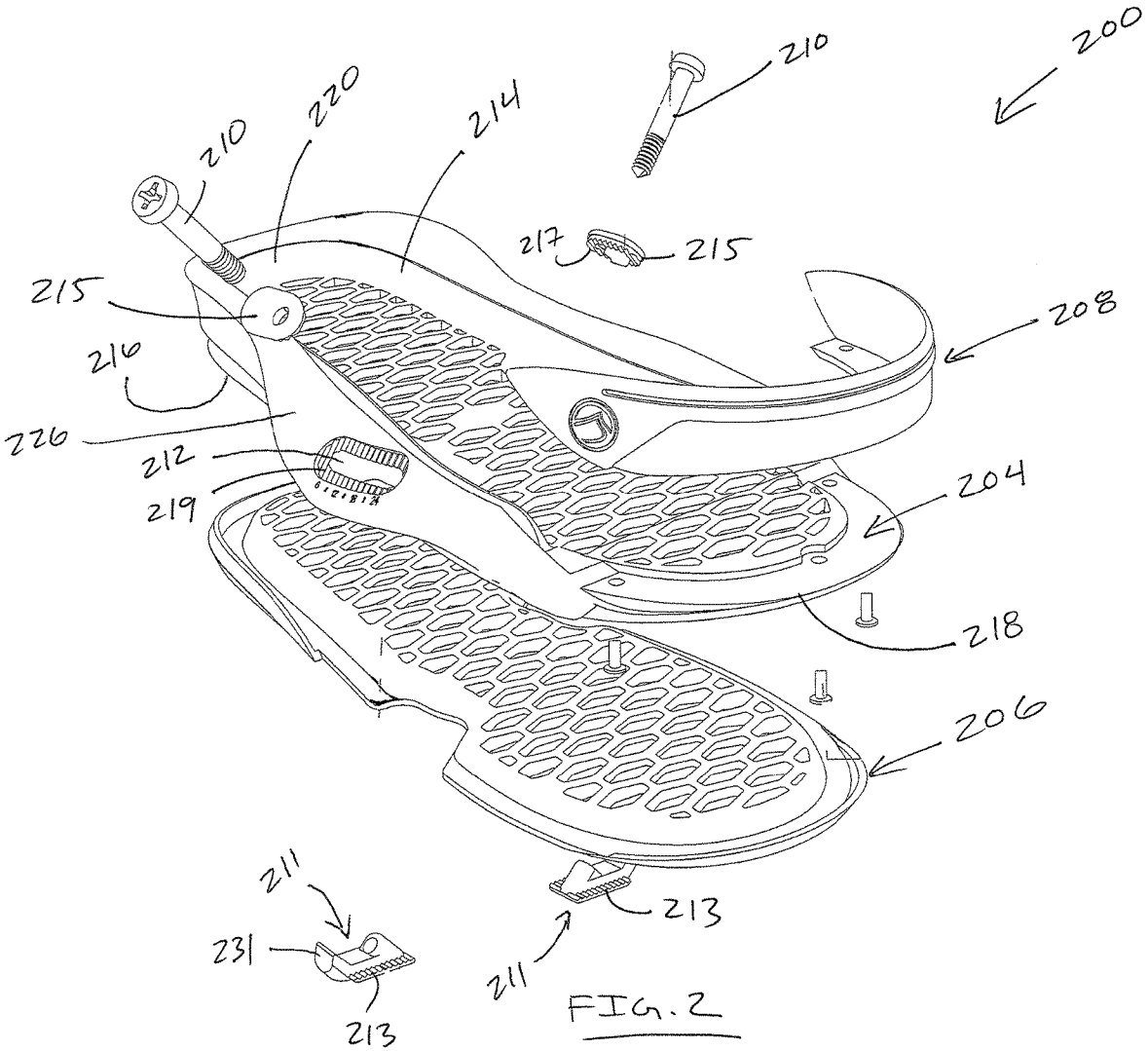
FIG. 2 shows an exploded view of the biding assembly of FIG. 1.

FIG. 2 illustrates an exploded view of an implementation of the binding assembly 200, which can include a chassis 204, a dampening member 206, a toe cap 208, attachment features 210, and binding attachment receptacles 211. The dampening member 206 can be positioned between the chassis 204 and a top surface of the sport board 102 and can be configured to assist with dampening forces directed between the user's foot and the board 102. For example, the dampening member 206 can be made out of one or more of a variety of materials that can assist with dampening and/or absorbing such forces. In addition, the dampening member 206 can be made out of thermoplastic elastomer and/or polyurethane material. The dampening member 206 and/or chassis 204 can include a honeycomb structure that extends substantially along the underside of the chassis and/or user's foot for effectively dampening and/or absorbing forces directed between the user's foot and the sport board.

The chassis 204 can assist with securing a user's foot to the binding assembly by securing the foothold or binding upper 101 to a part of the chassis 204. In addition, the chassis 204 can assist with securing the binding assembly 200 to the sport board 102. The chassis 204 can have a size and shape that extends at least as wide and as long as a user's foot that is coupled to the binding assembly. The chassis 204 can also come in various sizes to accommodate various sized feet. For example, an appropriately sized chassis 204 for a user can be one where the perimeter of the chassis 204 is at or just outside an outer perimeter of the user's foot or foot covering. As such, there is minimal material extending from the chassis 204 relative to the user's foot or foot covering when the user's foot is coupled to the binding assembly 200.

The chassis 204 can include a top side 214 that mates with the user's foot or foot covering, a bottom side 216 that mates with the dampening member 206, a toe region 218 that is configured to mate with a toe region of the user's foot or foot covering, and a heel region 220 that is configured to mate with a heel region of the user's foot or foot covering. The chassis 204 can also include opposing side regions, such as an inner side region 222 and an outer side region 224 (as shown in FIG. 3B), and a peripheral member 226 that extends along at least a part of the perimeter of the chassis 200.

Figure 3B:
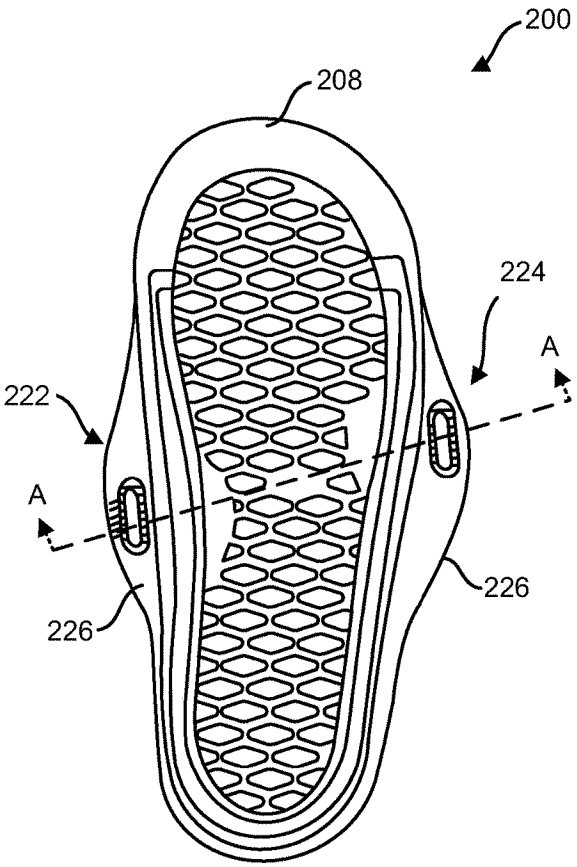
FIG. 3B shows a bottom view of the binding assembly of FIG. 1.
Figure 3A:
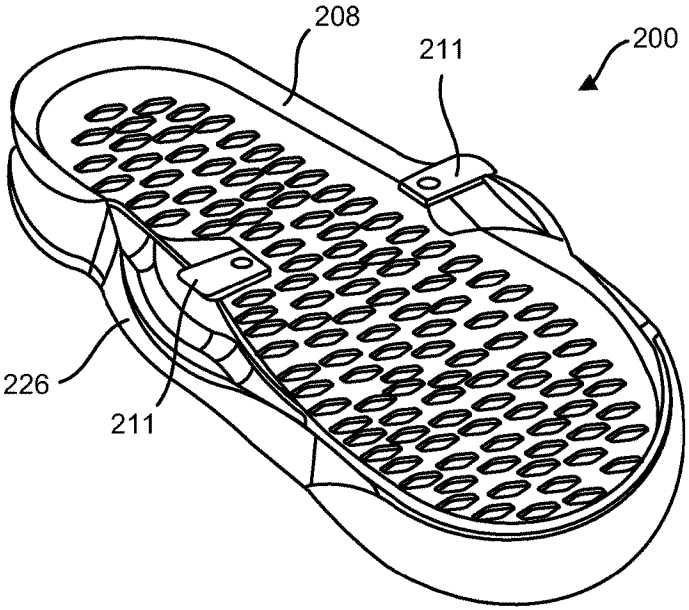
FIG. 3A shows a perspective view of a bottom side of the binding assembly of FIG. 1.

For example, the peripheral member 226 can extend a distance along the inner side region 222 and the outer side region 224, as shown in FIG. 3B. As also shown in FIG. 3B, the extensions formed by the peripheral member 226 can be non-symmetrical, such as having a peripheral member located along the outer side region 224 positioned closer to the toe region 218 compared to a peripheral member 226 located along the inner side region 222. However, the peripheral member can symmetrically extend relative to a centerline of the chassis 204.

The chassis 204 can also include a pair of connector receptacles 212 that each extend through the peripheral member 226 of the chassis 204 at an angle and allow an attachment feature to extend therethrough. For example, a first connector receptacle 212 can be positioned along an outer side region 224 of the peripheral member 226 and a second connector receptacle 212 can be positioned along an inner side region of the peripheral member 226. Furthermore, with reference to a user's foot anatomy, the first connector receptacle 212 can extend from an inner bridge area of the user's foot, and the second connector receptacle 212 can extend from an outer metatarsal region of the rider's foot. However, any number of connector receptacles 212 can be included in a binding assembly 200 and positioned in any number of locations along the binding assembly 200 without departing from the scope of this disclosure. Additionally, the passageway of the connector receptacle 212 can be angled inward towards a centerline of the chassis 204 such that the distal end of the attachment feature 210 is positioned within the perimeter of the chassis 204 and/or binding upper (with the upper being coupled to the chassis along an upper connector 440, as shown, for example, in FIG. 4).

Figure 4:
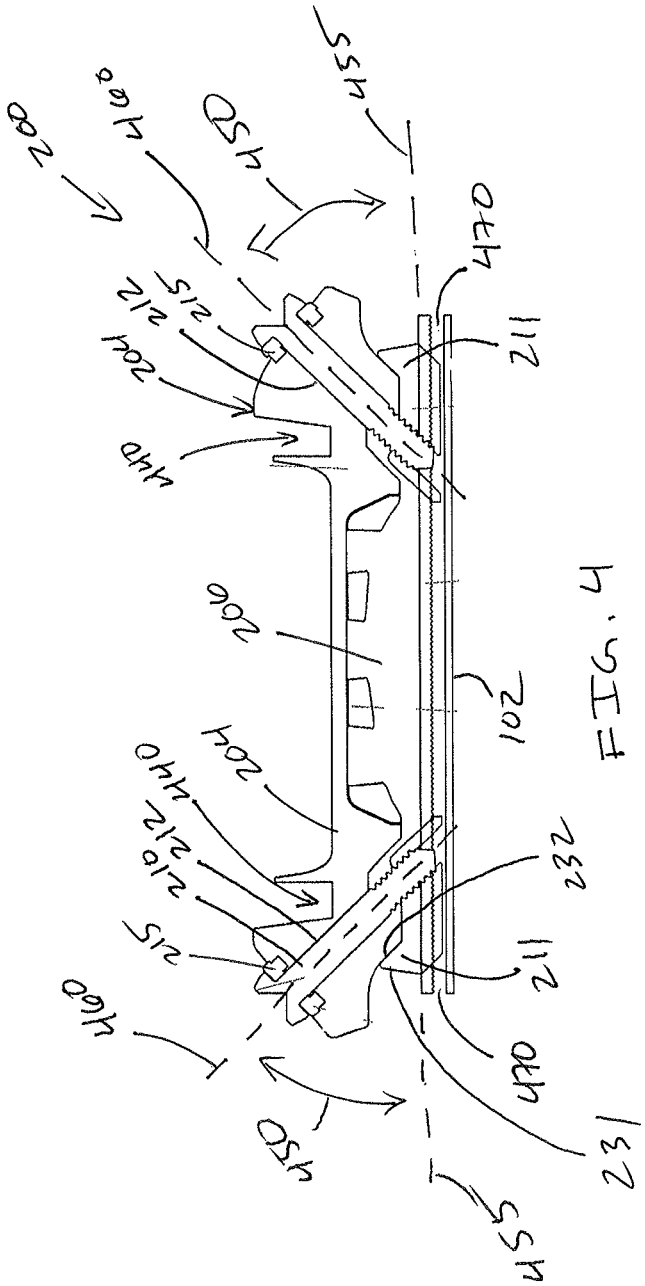
FIG. 4 shows a cross section view along line A-A of FIG. 3B illustrating the angled connector receptacles, including the angle formed between a longitudinal axis of the connector receptacles and the top surface of the sport board.

FIG. 4 illustrates an angle 450 at which the connector receptacles 212 are positioned relative to a top surface or plane 455 of the sport board 102. As shown in FIG. 4, longitudinal axis 460 of the connector receptacles 212 can form an angle 450 that is approximately 10 degrees to approximately 80 degrees or 35 degrees to approximately 55 degrees, such as 45 degrees, relative to the top surface 455 of the adjacent sport board 102. Attachment features 210 can extend through the connector receptacles 212 at the defined angle 450 for securing the binding assembly 200 to the sport board 102. As such, the attachment features 210 can be secured in place in an orientation defined by the connector receptacles 212. This angled coupling provides at least some of the benefits discussed above, such as resulting in a narrower chassis 204, increasing the stiffness and support of the chassis 204, and reducing "dead spots" along the sport board 102. In addition, by having the attachment features 210 secured within these defined angles 450, the durability of the attachment between the binding assembly 200 and the sport board 102 is improved.

As shown in FIG. 4, the binding assembly 200 can include an attachment receptacle 211 coupled to the sport board 102 that has an angled connection for accepting and securing the attachment feature 210 at the angle 450 defined by the connector receptacle 212. Although the attachment receptacle 211 is shown as a separate piece coupled to the sport board 102, the attachment receptacle can be integrated with the board 102.

As shown in FIGS. 1 and 4, the sport board 102 can include at least one track 470 that allows one or more attachment receptacles 211 to travel therealong. The track 470 can include a space that is formed between the top surface and the bottom surface of the sport board, as well as an opening along the top surface of the sport board. The track 470 can extend a distance along the board, such as along a longitudinal axis of the board, however, the track 470 can extend in any number of directions along any number of distances. The track 470 can allow the attachment receptacles 211 to adapt to various sized chassis 204. For example, chassis 204 of a binding assembly that is configured for an adult can have a greater width than a chassis 204 for a child. As such, the track 470 can allow the distance between the attachment receptacles 211 to be adjusted for allowing coupling to various sized chassis 204. Furthermore, the chassis 204 can include notches or engaging features 232 that allow an extension 231 of the attachment receptacles 211 to become properly aligned for securing an attachment feature extending through a connector receptacle 212, as shown in FIG. 4.

Some implementations of the track 470 can be configured such that the attachment receptacles 211 can be inserted and removed at one or more locations along the track 470, such as at an end of the track, while also being prevented from being inserted or removed along the remainder of the track. This can help prevent unwanted removal of the attachment receptacles 211, such as when the attachment receptacles are securely engaged with an attachment feature 210 for coupling the binding assembly 200 to the sport board 102, while also allowing for attachment receptacles 211 to be removed and replaced, as necessary. The attachment receptacle 211 can be made out of any number of materials, including stainless steel.

Some implementations of the attachment receptacle 211 can include any number of features for assisting with securing a position of the attachment receptacle 211 relative to the track 470. For example, some implementations of the attachment receptacle 211 can include one or more angled teeth 213 (see, for example, FIG. 2) that can mate with one or more complimenting angled teeth located along a part of the track 470. The angled teeth 213 of the attachment receptacle 211 can engage and lock against complimenting angled teeth as the attachment feature 210 becomes engaged and secured to the attachment receptacle 211.

In some implementations, the binding assembly can include one or more attachment locks 215, as shown in FIG. 2. The attachment locks 215 can assist with securing the attachment feature 210 relative to the chassis 204 for ensuring coupling of the binding assembly 200 to the sport board 102. For example, as shown in FIG. 2, the attachment lock 215 can be disc shaped and include one or more protrusions 217 that can engage complimenting protrusions 219 located adjacent or along the connector receptacles 212. The attachment lock 215 can be positioned between the proximal end of the attachment feature 210 and the connector receptacle 212 such that the protrusions 217 of the attachment lock 215 can engage the complimenting protrusions 219 and prevent sliding or disengagement between the chassis 204 and the attachment feature 210. The attachment feature can include any number of features, such as a threaded screw (e.g., stainless 40 mm screw).

Some implementations of the biding assembly 200 can also include a toe cap 208 that can be coupled to a toe region of the binding assembly 200. The toe cap 208 can extend a distance approximately perpendicular to the base of the chassis 204, as well as extend a distance around a part of the toe region of the binding assembly 200. The toe cap can provide a protective layer and can be made out of one or more of a variety of materials, such as a thermoplastics.

Figure 5B:
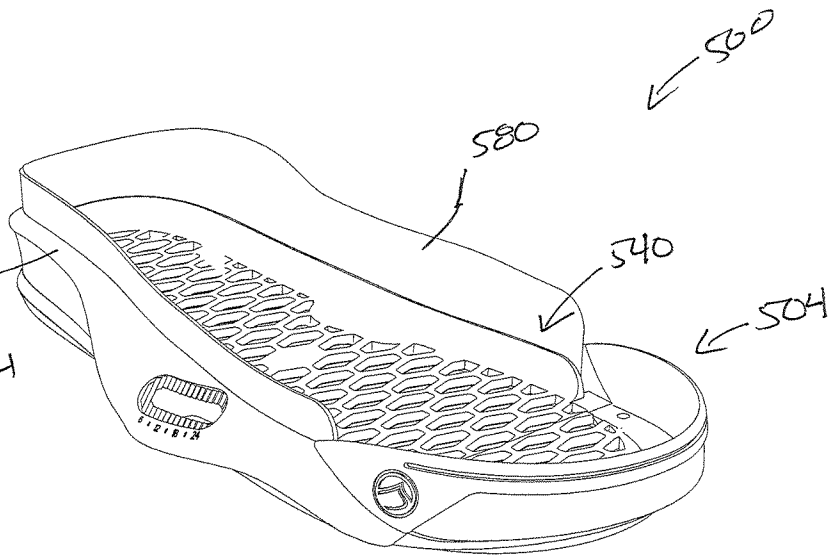
FIGS. 5A-5B illustrates another implementation of the binding assembly including an upper connector having a plurality of tabs that can couple to the chassis.
Figure 5A:
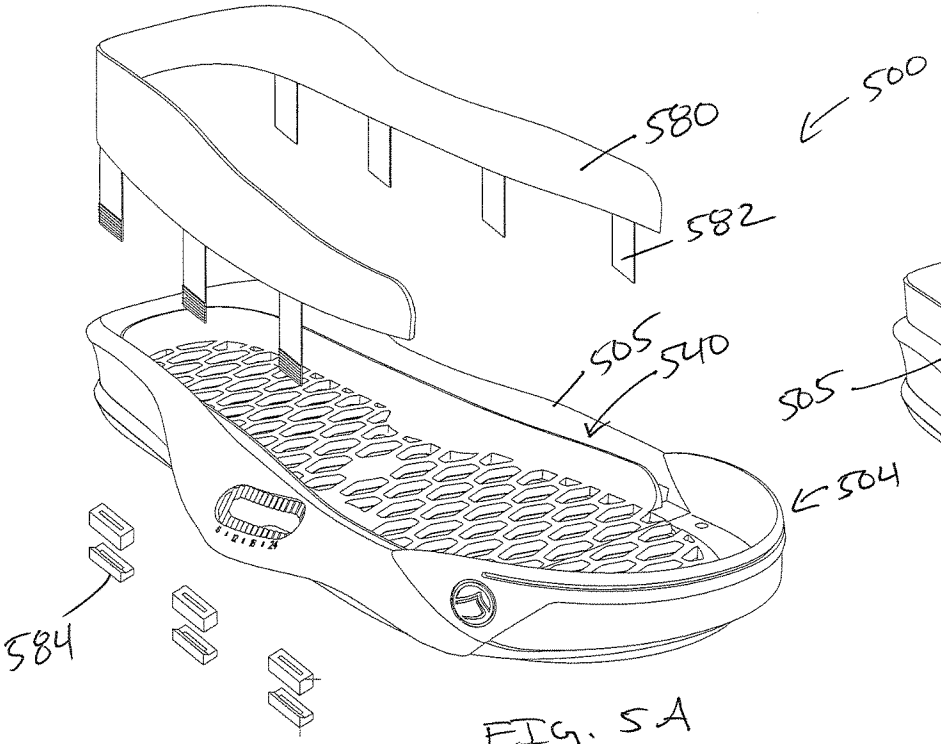

FIGS. 5A-5B illustrates another implementation of the binding assembly 500 having a chassis 504 that includes a peripheral member that partly extends perpendicular to the base of the chassis 504 to form a side member 505 that extends upwardly and defines an outer profile of at least a part of the chassis 504. An upper connector 540 can be adjacent such side member 505 for coupling a binding upper attachment 580 to the chassis 504. The upper connector 540 can include a cavity that is sized to accept a part of the binding upper or upper attachment 580.

As shown in FIG. 5A, the upper attachment 580 can include a plurality of downward projecting tabs 582 that can extend through a plurality of slots along the upper connector 540. Once the tabs 582 are extended through the slots, connector locks 584 can be secured to the tabs 582 thereby preventing the disengagement of the upper attachment 580 from the chassis 504. The binding upper can be secured to the upper attachment, thereby securing the binding upper to the binding assembly. Any length of the tabs 582 extending beyond a respective connector lock 584 can be cut away. The tabs 582 and connector locks 584 can have complimenting features (e.g., teeth) that allow their engagement but not disengagement, similar to a zip-tie. For example, each tab 582 can have a plurality of transverse ridges for engaging a connector lock 584 on an opposite of one of the plurality of slots of the chassis 504. This configuration can allow for fast and simple assembly of the upper to the chassis 504.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

The implementations set forth in the foregoing description do not represent all implementations consistent with the subject matter described herein. Instead, they are merely some examples consistent with aspects related to the described subject matter. Although a few variations have been described in detail herein, other modifications or additions are possible. In particular, further features and/or variations can be provided in addition to those set forth herein. For example, the implementations described above can be directed to various combinations and sub-combinations of the disclosed features and/or combinations and sub-combinations of one or more features further to those disclosed herein. In addition, the logic flows depicted in the accompanying figures and/or described herein do not necessarily require the particular order shown, or sequential order, to achieve desirable results. The scope of the following claims may include other implementations or embodiments.

What is claimed is:

1. A binding assembly for a sport board having at least two binding attachment receptacles in an upper surface of the sport board, the binding assembly being mountable to the upper surface of the sport board by at least two attachment features that correspond with the at least two binding attachment receptacles, the binding assembly comprising:

a chassis having a peripheral member that defines at least a part of a perimeter of the chassis, the perimeter having a toe region, a heel region, and outer and inner side regions, the chassis further having a top side for receiving an upper of a binding that receives a foot of a rider of the sport board, and a bottom side that faces the sport board when the chassis is mounted therewith, the chassis further having at least two connector receptacles through the peripheral member, at least one connector receptacle at each of the outer and inner side regions of the perimeter and extending through the peripheral member at an angle inward from each of the outer and inner side regions of the perimeter toward a central region of the chassis such that each attachment feature engages through one of the connector receptacles to engage one of the at least two binding attachment receptacles inside a perimeter of the upper of the binding to mount the binding assembly to the upper surface of the sport board.

2. The binding assembly in accordance with claim 1, wherein the angle is within a range of 35 degrees to 55 degrees relative to the upper surface of the sport board.

3. The binding assembly in accordance with claim 1, further comprising a dampening member that engages to an underside of the chassis as the chassis is mounted to the sport board by the attachment features.

4. The binding assembly in accordance with claim 3, wherein the dampening member is formed of a thermoplastic.

5. The binding assembly in accordance with claim 4, wherein the thermoplastic includes one of a thermoplastic polyurethane and a thermoplastic elastomer.

6. The binding assembly in accordance with claim 1, wherein the upper of the binding is attached to a boot that receives the foot of the rider of the sport board.

7. The binding assembly in accordance with claim 1, wherein the chassis further includes a plurality of slots for receiving a corresponding number of attachment mechanisms of the upper, each of the attachment mechanisms including a downward projecting tab, each tab having a plurality of transverse ridges for engaging an engagement mechanism on an opposite of one of the plurality of slots of the chassis.

8. The binding assembly in accordance with claim 1, wherein the chassis is at least one of formed out of a substantially rigid material and formed out of nylon.

9. The binding assembly in accordance with claim 1, wherein the peripheral member includes a side member that extends upwardly from the bottom of the chassis and that defines a shape of the bottom of the chassis.

10. The binding assembly in accordance with claim 1, wherein a first of the pair of connector receptacles extending from the chassis on opposite sides of the peripheral member extends from an inner bridge area of the rider's foot, and the second of the pair of connector receptacles extending from the chassis on opposite sides of the peripheral member extends from an outer metatarsal region of the rider's foot.

11. A binding assembly for a sport board having a pair of binding attachment receptacles in a planar upper surface of the sport board, the binding assembly comprising:

a rigid chassis having a peripheral member that defines a perimeter of the chassis, an underside, and a bottom for receiving an upper of a binding to receive a foot of a rider of the sport board, the peripheral member of the rigid chassis further having a pair of screw receptacles extending from the rigid chassis on opposite sides of the peripheral member, each of the pair of screw receptacles having an opening for receiving a mounting screw at an angle of between 10 and 80 degrees relative to the planar upper surface of the sport board so as to allow a proximal head of the mounting screw to engage with one of the pair of screw receptacles and a distal, threaded end of the mounting screw to protrude through the rigid chassis at the angle to extend under the bottom of the rigid chassis to engage with a corresponding one of the binding attachment receptacles of the sport board; and a dampening member that engages to the underside of the rigid chassis as the rigid chassis is mounted to the sport board by the pair of mounting screws.

12. The binding assembly in accordance with claim 11, wherein the angle is within a range of 35 degrees to 55 degrees relative to the upper surface of the sport board.

13. The binding assembly in accordance with claim 11, wherein the angle is 45 degrees relative to the upper surface of the sport board.

14. The binding assembly in accordance with claim 11, wherein the dampening member is formed of a thermoplastic.

15. The binding assembly in accordance with claim 14, wherein the thermoplastic includes one of a thermoplastic polyurethane and a thermoplastic elastomer.

16. The binding assembly in accordance with claim 11, wherein the upper of the binding is attached to a boot that receives the foot of the rider of the sport board.

17. The binding assembly in accordance with claim 11, wherein the rigid chassis further includes a plurality of slots for receiving a corresponding number of attachment mechanisms of the upper, each of the attachment mechanisms including a downward projecting tab, each tab having a plurality of transverse ridges for engaging an engagement mechanism on an opposite of one of the plurality of slots of the rigid chassis.

18. The binding assembly in accordance with claim 11, wherein the rigid chassis is formed out of nylon.

19. The binding assembly in accordance with claim 11, wherein the peripheral member includes a side member that extends upwardly from the bottom of the rigid chassis and that defines a shape of the bottom of the rigid chassis.

20. The binding assembly in accordance with claim 11, wherein a first of the pair of screw receptacles extending from the rigid chassis on opposite sides of the peripheral member extends from an inner bridge area of the rider's foot, and the second of the pair of rigid receptacles extending from the rigid chassis on opposite sides of the peripheral member extends from an outer metatarsal region of the rider's foot.

* * * * *